US006134843A

United States Patent [19]

Tregear

[11] Patent Number: 6,134,843

[45] Date of Patent: Oct. 24, 2000

[54] GUTTER SHIELD

[76] Inventor: Marc Tregear, 8723 W. Chester Pike, Apt. C5, Upper Darby, Pa. 19082

[21] Appl. No.: 09/139,217

[22] Filed: Aug. 24, 1998

[51] Int. Cl.[7] ..... E04D 13/64

[52] U.S. Cl. ..... 52/12; 52/11; 210/474

[58] Field of Search ..... 52/11, 12; 210/474

[56] References Cited

U.S. PATENT DOCUMENTS

| | | | |
|---|---|---|---|
| 3,121,684 | 2/1964 | Bugbird . | |
| 4,351,134 | 9/1982 | Clarkson . | |
| 4,841,686 | 6/1989 | Rees . | |
| 4,907,381 | 3/1990 | Ealer | 52/12 |
| 4,941,299 | 7/1990 | Sweers | 52/12 |
| 5,107,635 | 4/1992 | Carpenter | 52/12 |
| 5,271,192 | 12/1993 | Nothum, Sr. et al. | 52/12 |
| 5,535,554 | 7/1996 | Harris, Jr. | 52/12 |
| 5,592,783 | 1/1997 | Jones | 52/12 |

OTHER PUBLICATIONS

Birch Industries Inc., "Gutter Claw™" flyer.

Birch Roofing & Gutters, door hanger with address.

DCI, "Flo–Free™" flyer, copyright 1993, DCI.

DCI, "Flo–Free™" post card advertisement.

American Metal Products, "Never Clean Your Gutters Again™" flyer for Gutter Helmit System, copyright 1997.

Benjamin Obdyke Incorporated, "WaterFall Keeps Debris Out of Gutter" flyer, "Printed 1997".

LeafGuard Mid Atlantic, "The Gutter That Never Clogs . . . Guaranteed!™" flyer, Copyright Apr. 1997.

Absolute Gutter Protection, LLC., "Gutter ProTech™" flyer, Copyright 1997.

Benjamin Obdyke Incorporated, "Roll Vent Attic Ventilation System" 8.5×11." flyer, Copyright 1997.

Benjamin Obdyke Incorporated, "Roll Vent$^R$ Attic Ventilation System" 8.5×11" flyer, Copyright 1996.

Benjamin Obdyke, Incorporated, "Roll Vent$^R$ Attic Ventilation System" small flyer, Copyright 1994.

*Primary Examiner*—Carl D. Friedman
*Assistant Examiner*—Phi Dieu Tran A
*Attorney, Agent, or Firm*—John S Munday

[57] ABSTRACT

A gutter shield device used with gutters having inboard and outboard edges. The device includes an elongated matting having a plurality of open cones arranged in transverse and longitudinal rows, the bases of the cones defining a lower first plane and the apexes of the cones defining an upper second plane. The matting further including a pair of lateral lips extending outwardly from the bases of the cones. Also included is an elongated strip of porous fabric sufficiently smooth to prevent debris from being retained thereon. The being fabric is bonded to the cone apexes. In one embodiment, the device includes a reinforcing strip proximate its outer edge. A preferred matting is nylon embedded with carbon black and the preferred water porous fabric is a non-woven nylon-polyester.

6 Claims, 1 Drawing Sheet

GUTTER SHIELD

FIELD OF THE INVENTION

The present invention relates to a gutter shield for use with installed gutters on buildings such as houses. More particularly, the invention relates to a gutter shield device that is adapted to be fitted to a variety of gutters and permits rain water to drain into the gutters while preventing debris such as leaves, pine needles, twigs, and roofing shingle particles from entering and clogging the gutters.

BACKGROUND OF THE INVENTION

Rain gutters are a ubiquitous part of every house and most buildings and serve to collect rain water runoff from their roofs and discharge it at selected locations, normally through down spouts. Not only do gutters prevent runoff from the roof's surface falling directly onto the surrounding lawn or garden causing pitting or trenching of the lawn or garden but the down spouts direct the water away from the buildings' foundations decreasing the risk of water seepage and damage to cellars from normal rain falls.

However due to the proximity of many homes and buildings to trees, and to the shedding of particles from many roofing materials, installed gutters may become obstructed or clogged with, for example, dead leaves, pine needles, twigs, and roofing shingle particles thus interfering with the free flow of rain water runoff along the gutters and into and down the down spouts. This can cause the rain water to flow over the edge of the gutters, pitting or trenching of the lawn below, and during periods of freezing weather causes the accumulated water to freeze creating further obstruction to later rain fall runoff. If the gutters or down spouts become clogged with leaves and other material blocking passage of rain water, freezing may burst portions of the gutter system requiring repair or replacement. Gutters must therefore be routinely cleaned to remove the debris which is a time consuming, dirty job and for most homes can be a dangerous job for the home owner and requires them to hire professionals to do the required cleaning and maintenance.

Many devices and systems have been used in attempts to prevent or minimize this natural collection of leaves, twigs or roofing material in gutters and down spouts. For example Bugbird U.S. Pat. No. 3,121,684 discloses an hollow cage down spout strainer device resembling an inverted kitchen whisk having a weight affixed to its lower end and a protruding wire loop at its upper end. The Bugbird device is placed into the upper end of a down spout by use of a long pole having a hook at its upper end that engages the wire loop of the device. The weight maintains the strainer upright and in the down spout. The device allows rain water to pass from the gutter into the down spout while catching leaves and other larger foreign matter from entering the down spout. However the Bugbird hollow cage device does not prevent foreign matter from entering the gutters themselves which will create clogging in the gutters and permits smaller matter from entering the down spout. It also requires routine careful removal and cleaning out of the accumulated material caught by the device, and of the material in the balance of the gutters. During heavier periods of accumulation of debris in the gutters, such as in the Fall season, the Bugbird strainer can catch enough leaves during a single rainfall to effectively clog entry to the down spout.

An example of a device used to regularly clean out debris from gutters is the GUTTER CLAW™ cleaner sold by Birch Industries Inc. of Skippack, Pa. It consists of a six foot pole having a universal blade attached to its further end for scrapping and cleaning of gutters by a person proximate the height of the gutter. While this makes the task of cleaning-out gutters a bit easier and more efficient, it does not prevent clogged gutters from occurring in the first place.

Many devices have been devised to prevent foreign material from entering the rain gutters and subsequently down spouts. For example, gutter guards made of wire mesh, commonly sold in rolled form, must be unrolled or flattened prior to attachment to the gutters. Further, the wire mesh may become deformed during manufacture, shipment, unrolling at the site, or installation thus decreasing its effectiveness. Smaller matter may still work its way through the mesh design necessitating removal of the wire mesh design devices and direct cleaning of the gutter trench. Attempts at hinging these wire mesh designs to facilitate exposure of the gutter trench for cleaning results in less than optimal installation, and deformation of the wire mesh tends to interfere with movement of the wire mesh designs from the covered to exposed positions over the gutter trench.

Clarkson U.S. Pat. No. 4,351,134 attempts to improve upon these wire mesh designs and discloses a hinged gutter guard device in the form of an elongated perforated cover plate made of a relatively rigid material having hinge straps along one longitudinal edge and is designed to cover the open gutter trench. The hinge straps are positioned within longitudinal slots and are adapted to be secured to a roof beneath the lower course of shingles. The straps can be shifted within their slots to ensure proper attachment and operation. However, smaller material, such as shingle debris can still pass though the Clarkson design perforations and although the hinged design eases cleaning of the gutter trench, they still must be cleaned. Further, in heavy rainfall, the force of the rain water off the roof impacting the Clarkson design can cause part of the water to skid off the Clarkson gutter guard entirely and fall directly on the lawn below causing pitting or trenching. Attachment to the roof by the preferred method involves embedding an exposed barb on the tongue portion of each hinge strap into the underside of the shingles. Over time, the prolonged stress of the weight of the Clarkson gutter guard during normal use and the stress of raising and lowering of the gutter guard about the hinge straps can weaken or tear the shingles to which they are attached necessitating repair or replacement of the shingles.

Another patent, Rees U.S. Pat. No. 4,841,686, discloses a filter attachment constructed to fit over the gutter trench. The filter attachment comprises an elongated screen with a pad of fibrous material, such as fiber glass, clamped to the screen's underside. Adjustable clamping means hold the filter attachment in place over the gutter trench. The screen has from 0.25 to 0.50 inch square openings. However, these openings can trap smaller particles such as shingle material and requires cleaning or removal of this built up material on the surface of the screen to prevent clogging of the screen. Since the screen's apertures trap this smaller debris within them, cleaning can be difficult and time consuming.

There are also several commercial products designed to prevent foreign matter buildup in gutters. For example the FLOW-FREE™ gutter protection system sold by DCI of Clifton Heights, Pa. comprises a 0.75 inch thick nylon mesh material designed to fit within 5 inch K type gutters to seal the gutters and down spout system from debris and snow buildup. The FLOW-FREE device fits over the hanging brackets of the gutters and one side extends to the bottom of the gutter to prevent its collapse into the gutter. However, the FLOW-FREE gutter protection system is pre-cut to fit only 5 inch K gutters while many home owners have other types of gutters. Further, debris, in particular shingle material and pine needles, can become trapped in the coarse nylon mesh material and must be cleaned to avoid blocking the flow of rain water through the nylon mesh. Because of the coarseness of the nylon mesh material, attempts at cleaning it is very difficult, if not impossible, and can just further embed the foreign matter deeper into the mesh.

Another commercial product is the GUTTER HELMET® gutter protection system manufactured by American Metal Products and sold by, for example, Delaware Valley Gutter Helmet of Frazer, Pa. The GUTTER HELMET device covers most of the gutter with a bullnose shaped protrusion proximate the outer edge of the gutter. The surface tension design of the bullnose facilitates channeling of rain water down the bullnose into the gutter while leaves and other debris are designed to blow over the top of the bullnose.

However the GUTTER HELMET device is affixed to the edge of the roof by screws, for example, which can lead to leaks through the roof. Also, many times the building's existing gutters must be re-pitched to obtain a proper downslope of the GUTTER HELMET device to permit rain water to flow down the bullnose and into the gutter. Without re-pitching, rain water may puddle next to the roof and under the shingles leading to roof rot and damage. Unless and until the bullnose is completely wetted, the surface tension design is not efficient and water may drip directly onto the lawn below potentially leading to soil erosion and water in the building's basement. In cold weather, the dripping water causes icicles to form which are unsightly and can fall, becoming a safety hazard.

Further, a dirt mildew builds up on the bullnose preventing water from flowing into the gutter and necessitating the bullnose be routinely scrubbed and cleaned to remove this dirt mildew. Installation of the GUTTER HELMET device is relatively expensive and additional expense is involved for certain installations. For example, installation on ½ round type gutters requires that the back of the GUTTER HELMET device be filled in to prevent birds from nesting in the opening. Installation on flat roofs requires cutting and bending of the GUTTER HELMET device so that it can be attached to the facie board.

Additionally, diverters must be installed in all valleys of a roof and where a great deal of water must be dispersed. Otherwise the force of the excess rain water greatly decreases the efficiency of the bullnose design and some water will run off the bullnose and fall to the lawn or surface below. In some installations, the GUTTER HELMET device has been known to buckle from the heat of the sun. Some debris, such as shingle particles, may be heavy enough that they would wash down with the water into the gutter and not be blown off during periods of rain as designed. Over time, the gutters and down spouts could become clogged by such debris which would require removal of the GUTTER HELMET device to clean the gutters and down spouts.

The Englert LEAFGUARD™ gutter protection system, sold by, for example, LeafGuard Mid Atlantic, of Woodlyn, Pa. is somewhat similar in design to the GUTTER HELMET gutter protection system in that surface tension or liquid adhesion of the rain water is used to direct the water into the gutter along a bullnose design through a narrow opening next to the outer gutter lip while leaves, etc., are designed to be deflected away from the gutters.

However the LEAFGUARD device is a one piece, seamless K style gutter system and can not be retrofitted on existing gutter systems. The gap between the bullnose and the outer lip of the gutter trench is even greater than that of the GUTTER HELMET so debris still falls into, and accumulates in, the gutter trench. This requires routine cleaning which is difficult since it is a one piece system and the bullnose portion can not be separated from the gutter trench portion. The gap is also large enough that birds may nest in the gutter trench leading to clogging. Also, down spouts are needed every twenty five feet of gutter length which increases cost affects the aesthetics of the gutter system installation. Again, diverters are needed in the valleys of the roof, among other places, to handle expected larger flows of rain water, and the bullnose must first be sufficiently wetted to work properly. Dirt mildew buildup is also a problem and must be routinely scrubbed and cleaned off.

The GUTTER PROTECH™ gutter protection system, sold by Absolute Gutter Protection, L.L.C. of Woodbury, N.J. is also designed to use surface tension and liquid adhesion of rain water to direct rain water into the gutter trench through two rows of alternating angled slots over mini-bullnoses. Small debris, such as shingle material, may follow the water runoff into the gutter trench eventually requiring removal of the GUTTER PROTECH device to clean the gutter trench. As in similar designs, the bullnoses must first be sufficiently wetted to work properly and dirt mildew buildup on the bullnoses must be routinely scrubbed and cleaned off. Diverters are also again required to handle expected larger flows of rain water to ensure the runoff flows into the gutter trench via the bullnoses.

Finally, the WATERFALL™ plastic gutter guard system, manufactured by Benjamin Obdyke Incorporated, also uses the principle of liquid adhesion and includes two sets of parallel channels each having drain holes. Rain water flows from the roof onto the WATERFALL device with some of the water flowing over the bullnose structure of the upper channel and into the upper channel, through its drain holes and into the gutter trench, The second, lower channel, is likewise designed to collect any remaining runoff and direct it into the gutter trench via its bullnose and drain holes.

However debris tends to accumulate in the parallel channels and they must be routinely cleaned out. Since the WATERFALL device is made of plastic, it can crack in cold weather degrading its performance and requiring replacement. Separate sections are just abutted to the adjoining sections and secured. However the abutted sections tend to separate and allow debris to collect in the gutter trench necessitating removal of the WATERFALL device and cleaning the gutter trench. Since the device does not include end caps, birds can gain entry into the gutter trench at the ends and build nests. The device is designed to just slide under the lower row of shingles without otherwise being attached, so it tends to separate from beneath the shingles and can be blown off the gutters. Also, the number of different type gutter systems onto which the WATERFALL device may be installed is limited.

None of these above-described systems keep all debris out of gutter systems allowing just rain water to drain into gutter trenches. An unacceptable buildup of debris, either on the surface of the devices or within the gutter trenches or down spouts, almost always eventually occurs.

Accordingly, it is an object of the present invention to provide a gutter shield that permits drainage of rain water runoff into the gutter trench without an unacceptable accumulation of debris either on the outer surface of the system or within gutter trenches or down spouts forcing routine cleaning.

A further object of this invention is to provide a gutter shield that can be retrofitted to most any type of existing gutters on most any roof design.

Another object of this invention is to provide a gutter shield that is economical to manufacture and install.

Yet another object of this invention is to provide a gutter shield that is not adversely affected by the elements such as extreme heat or cold.

Other objects will appear hereinafter.

SUMMARY OF THE INVENTION

It has now been discovered that the above and other objects of the present invention may be accomplished in the following manner. Specifically, the present invention provides a gutter shield for use with gutters having an elongated opening and preferably inner and outer lips. Normally the gutters are attached to a building.

The gutter shield device comprises a matting and a covering. The matting is an elongated three dimensional matting including a plurality of shapes arranged in rows, the bases of the shapes defining a first plane and the apexes of the shapes defining a second plane. The matting should extend outwardly from the bases. The covering is an elongated strip of water porous fabric having an upper and lower surface. The upper fabric surface is sufficiently smooth to prevent debris from being retained by the fabric material and facilitates debris being blown off by ambient winds. The lower fabric surface is bonded to the matting.

One longitudinal edge of the fabric extends outwardly for mounting the device to the building and the other longitudinal edge of the fabric extends outwardly for attachment to the outer lip of the gutter, thus effectively positioning the device over the opening of the gutter.

The preferred plurality of shapes are pyramidal shaped cones made of nylon having carbon black to resist the detrimental effects of ultraviolet light. The cones are arranged in transverse and longitudinal rows. The preferred water porous fabric is non-woven nylon-polyester. The water porous fabric is preferably heat bonded to the matting.

In one embodiment, one longitudinal edge of the fabric includes a reinforcing strip affixed to the fabric. Similarly, the other longitudinal edge of the fabric may also include a reinforcing strip.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
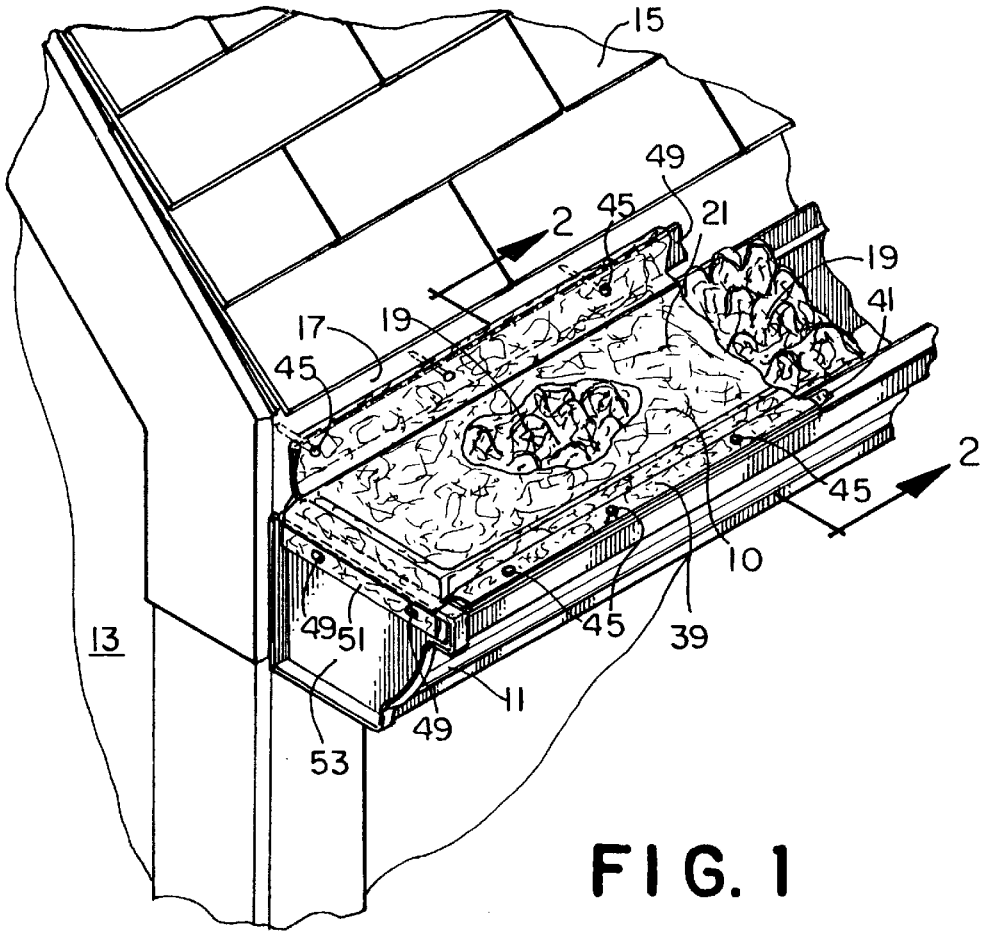
FIG. 1 is a perspective view illustrating the preferred embodiment of the present invention, in which the device is placed in a building gutter, with portions cut-away for illustration of its construction.

As shown in the drawings, the present invention, generally shown as 10, is attached to a gutter 11, which in turn is mounted on a house 13 or other building having a sloped roof 15. When weather conditions deposit rain or snow on roof 15, water eventually runs down the slope and enters gutter 11, provided of course to direct the water via down spouts and other means for diverting water to a desired location for proper disposal and elimination of damage to the building and surrounding property.

The device 10 is intended to be attached to the gutter 11, as described below, and also to be fastened to facing 17 of the house, if present, or to another part of the structure to insure a permanent attachment of the gutter shield device.

The gutter shield device of this invention is comprised of two major components. Supporting the device and mounting it to the building is an underlying matting 19, described in detail below, over which has been placed a fabric 21 or other porous material. Matting 19 engages the inner lip 23 of gutter 11 on one edge and outer lip 25 on its other edge, so as to overly the entire length of gutter 11 and present an elongated, three dimensional barrier preventing objects from entering the bottom of gutter 11. Matting 19 is stiff enough to support the device, and is formed from a plurality of shapes 27 arranged in rows, whereby the bases 29 of shapes 27 defines a first plane and the apexes 31 of shapes 27 defines a second plane, thus giving matting 19 a three dimensional shape. Preferred shapes 27 are cone-like shapes, somewhat pyramidal in construction. Matting 19 is preferably constructed from polyamides such as Nylon 6, and is most preferably formed with the presence of carbon black to provide resistance to ultraviolet light which may degrade the polyamide.

Fabric 21 covers matting 19 and is preferably attached at the top of shapes 27, such as by heat bonding, such that fabric 21 lies in the second plane formed by the apexes 31 of shapes 27. A preferred material for fabric 21 is a non-woven nylon-polyester. Fabric 21 must be water porous, so water running off roof 15 into gutter 11 is allowed to pass through into the drain and down spout portions of the gutter system. The upper surface 21*a* of fabric 21 is sufficiently smooth to prevent debris from being retained by the fabric, so that when the rain or snow is gone, the debris will naturally dry and be blown off by ambient winds, thus leaving the upper surface 21*a* debris free. Lower surface 21*b* of fabric 21 is heat bonded or otherwise attached to apexes 31, as described above.

It has been discovered that a commercially available attic ventilation system known as Roll Vent® attic ventilation system, manufactured by Benjamin Obdyke, Incorporated, Warminster, Pa. is suitable, with modifications as discussed below, as part of the device of this invention since it is formed of a matting and fabric as described above.

In addition to the cone-like shapes 27 defining the two planes, the matting 19 should have a portion, without said shapes, and extending outwardly from the bases 29 in the first plane defined by said bases 29. On the side intended to engage the outer lip 25 of gutter 11, a portion 37 of matting 19 extends out from bases 29, preferably by the distance between rows of shapes 27, to provide a small area 37 which engages lip 25. The distance matting 19 extends out toward inner lip 23 is not as important, though some extension is helpful for engagement with inner lip 23 and additional structural support and attachment of reinforcing materials as described below.

Figure 2:
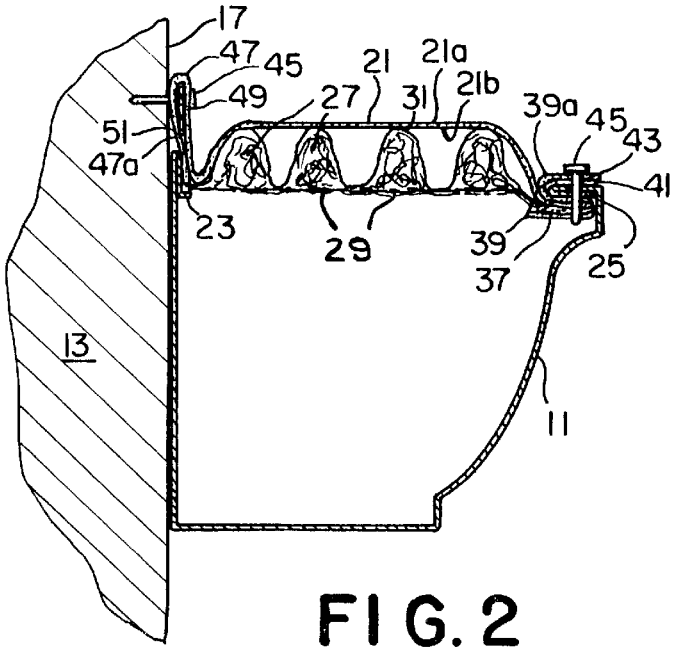
FIG. 2 is a section view taken along the line 2—2 in FIG. 1.

Fabric 21 also extends outward in the first plane, defined by bases 29, in both transverse directions to the length of the device. A portion 39 of fabric 21 extends toward outer lip 25, covering area 37 to again prevent debris from lodging in the device, and may extend even further, as shown in FIG. 2 at 39*a*, with optional reinforcing strip 41 attached to its underside. Holes 43 in the outer lip 25 of gutter 11 are provided, whereby zip screws 45, or other fastening agents, pass through covering extension 39*a*, reinforcing strip 41, and holes 43 in gutter outer lip 25 to secure device 10 to outer gutter lip 25.

The other longitudinal length of the device includes a portion 47 of fabric 21 extending toward inner lip 23 of gutter 11. Again fabric portion 47 may extend far enough to loop back on itself as fabric 47*a*, to provide a doubled layer of fabric 47 and 47*a*, between which a reinforcing strip 49 may be placed. Holes 51 and zip screws 45 are positioned for attachment of the present invention to facing 17 of house 13, thus securing the other end to the house. This engagement of mating extensions with inner and outer lips 23, 25, respectively, and the combination of mounting along both lengths fixedly mounts the device to gutter 11 to provide a permanently effective gutter shield device in place.

The exposed ends of matting 19 may be covered by a portion 51 of fabric 21 extending over the exposed end of matting 19 and onto the end cap 53 of gutter 11. Fabric portion 51 is then secured to end cap 53 by zip screws 49.

While particular embodiments of the present invention have been illustrated and described, it is not intended to limit the invention, except as defined by the following claims.

I claim:

1. A gutter shield device used with gutters having inboard and outboard edges, the gutters being attached to a building, the gutter shield device comprising:

an elongated matting including a plurality of open, pyramidal shaped cones arranged in transverse and longitudinal rows, the bases of said cones defining a lower first plane and the apexes of said cones defining an upper second plane; said matting further including a pair of first and second lateral lips extending outwardly from said bases of the outside longitudinal rows of said cones, said lateral lips having upper and lower surfaces, said outside longitudinal rows having exposed outward sides;

an elongated strip of water porous fabric having an upper and lower surface, said upper fabric surface being sufficiently smooth to prevent debris from being retained by said fabric material to facilitate the debris being blown off by ambient winds, said lower fabric surface being bonded to said cone apexes in said second plane, said lower surface of said fabric being bonded to said exposed outward sides of said rows and said upper surfaces of said first and second lateral lips of said matting, said covered lateral lips adapted to engage the underside of the edges of the gutter;

a first wing extending from said strip of fabric beyond the outer edge of said first lateral lip, said first wing being positioned for attachment to the building proximate the gutter; and a second wing affixed to said strip of fabric proximate the outer edge of said second lateral lip, said second wing being positioned for attachment to the outboard gutter edge.

2. The gutter shield device of claim 1, further including a reinforcing strip proximate the outer edge of said second wing so that said matting strip overlies the outboard edge of the gutter.

3. The gutter shield device of claim 2, wherein said reinforcing strip comprises flattened matting material.

4. The gutter shield device of claim 1, wherein said matting is nylon and carbon black and said water porous fabric is non-woven nylon-polyester.

5. The gutter shield device of claim 4, wherein said first and second wings are non-woven nylon-polyester.

6. The gutter shield device of claim 1, wherein said fabric is heat bonded to said matting.

* * * * *